US011812867B2

(12) United States Patent
Atkinson

(10) Patent No.: US 11,812,867 B2
(45) Date of Patent: Nov. 14, 2023

(54) BEDDING SYSTEM, APPARATUS, AND METHOD

(71) Applicant: Jennifer Atkinson, Hoboken, NJ (US)

(72) Inventor: Jennifer Atkinson, Hoboken, NJ (US)

( * ) Notice: Subject to any disclaimer, the term of this patent is extended or adjusted under 35 U.S.C. 154(b) by 0 days.

(21) Appl. No.: 17/712,483

(22) Filed: Apr. 4, 2022

(65) Prior Publication Data

US 2023/0309709 A1 Oct. 5, 2023

(51) Int. Cl.
*A47C 31/10* (2006.01)
*A47C 27/00* (2006.01)

(52) U.S. Cl.
CPC ..... *A47C 31/105* (2013.01); *A47C 27/007* (2013.01)

(58) Field of Classification Search
CPC ..... A47C 31/00; A47C 31/10; A47C 31/105; A47C 31/113; A47C 27/007
See application file for complete search history.

(56) References Cited

U.S. PATENT DOCUMENTS 3,965,504 A 6/1976 Ainsworth
4,301,561 A * 11/1981 McLeod ..... A47G 9/02 5/923
4,922,565 A 5/1990 Blake
4,924,543 A * 5/1990 Hoss ..... A47G 9/0253 5/490
4,965,184 A * 10/1990 LeStrange ..... G03C 1/10 430/599
5,042,099 A 8/1991 Brenner
5,086,530 A 2/1992 Blake
5,321,862 A 6/1994 Campbell
5,367,729 A 11/1994 Lazar
5,438,719 A * 8/1995 Anthony ..... A47G 9/02 5/490
5,732,424 A 3/1998 Bond
5,884,349 A * 3/1999 Gretsinger ..... A47G 9/02 5/497
6,651,278 B2 11/2003 Ghanem
6,739,002 B1 5/2004 Pannu
6,859,962 B2 3/2005 Diak/Ghanem
6,886,197 B1 * 5/2005 Madigan ..... A47G 9/02 5/493
7,207,078 B1 4/2007 Lakic
7,487,560 B2 2/2009 McGrath
8,151,386 B2 4/2012 McKee
8,656,535 B1 2/2014 Adomney
9,872,575 B2 1/2018 Mikesell
2003/0177579 A1 * 9/2003 Diak/Ghanem ..... A47G 9/02 5/484
2008/0222805 A1 9/2008 Saunders
2011/0214233 A1 9/2011 Stang
2019/0365123 A1 * 12/2019 Weinhoffer ..... A47G 9/0246

* cited by examiner

*Primary Examiner* — Fredrick C Conley
(74) *Attorney, Agent, or Firm* — Keefe IP Law, PLLC

(57) ABSTRACT

A method for making a bed having a mattress is disclosed. The method includes permanently attaching a mattress assembly to the mattress, removably attaching a sheet assembly to the mattress assembly, the sheet assembly including a first sheet member, which includes a fluid barrier layer, and a second sheet member, and blocking fluid using the fluid barrier layer from moving from the sheet assembly to the mattress assembly when the sheet assembly is removably attached to the mattress assembly.

20 Claims, 5 Drawing Sheets

BEDDING SYSTEM, APPARATUS, AND METHOD

TECHNICAL FIELD

The present disclosure generally relates to a system, apparatus, and method, and more particularly to a bedding system, apparatus, and method.

BACKGROUND

Conventional bedding systems typically involve relatively time-consuming and burdensome techniques for stripping used sheets from a bed and replacing those used sheets with clean sheets. For example, conventional systems typically involve lifting a mattress to remove corner and end portions of used sheets and to secure or tuck in corner and end portions of clean sheets. Conventional systems also typically involve separately folding and unfolding bedding system components such as mattress covers and sheets each time a bed is stripped of used sheets and remade with clean sheets. Conventional systems configured to protect against bodily fluids such as bedding systems for children or hospitals typically also include a separate mattress protector that is added as an additional element under bed sheets.

U.S. Pat. No. 8,656,535 issued to Adorney (the '535 patent) attempts to address some of the above shortcomings in the prior art by providing a first sheet that is secured to a mattress and a second "T" shaped sheet that is removably attachable to the first sheet. However, in the case of an accident involving bodily fluids or of extended use over time, both the first sheet and second sheet of the '535 patent would apparently be removed to be cleaned, which would involve lifting the mattress to remove and replace the first sheet. For example, the '535 patent discloses at col. 3 at lines 26-28 that "the first sheet is affixed to the mattress in the usual manner, but this chore need be done perhaps every few months" as best understood apparently based on extended use. As best understood, the first sheet would also be changed after each accident involving bodily fluids. Accordingly, the first sheet of the '535 patent still appears to involve cleanings, and apparently becomes increasingly dirty and used over time between cleanings. The sheets of the '535 patent also appear to involve folding and unfolding between cleanings.

The exemplary disclosed system, apparatus, and method of the present disclosure are directed to overcoming one or more of the shortcomings set forth above and/or other deficiencies in existing technology.

SUMMARY OF THE DISCLOSURE

In one exemplary aspect, the present disclosure is directed to a method for making a bed having a mattress. The method includes permanently attaching a mattress assembly to the mattress, removably attaching a sheet assembly to the mattress assembly, the sheet assembly including a first sheet member, which includes a fluid barrier layer, and a second sheet member, and blocking fluid using the fluid barrier layer from moving from the sheet assembly to the mattress assembly when the sheet assembly is removably attached to the mattress assembly.

In another aspect, the present disclosure is directed to an assembly for making a bed having a mattress and a pillow. The assembly includes a non-washable mattress assembly configured to be permanently attached to the mattress for a remainder of a service life of the mattress, a sheet assembly configured to be removably attached to the mattress assembly, the sheet assembly including a first sheet member, which includes a fluid barrier layer, and a second sheet member, a cover member configured to be removably attached to the sheet assembly, and a bedding member that includes two fixedly attached side portions and two removably attachable side portions configured to receive the pillow through the two removably attachable side portions when the two removably attachable side portions are detached.

DETAILED DESCRIPTION AND INDUSTRIAL APPLICABILITY

Figure 1:
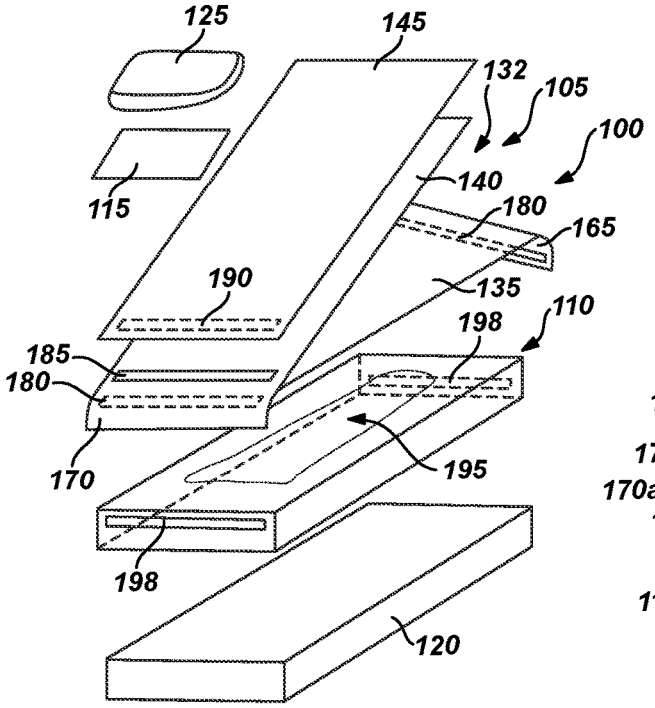
FIG. 1 is an exploded, perspective view of an exemplary embodiment of the present invention.
Figure 2:
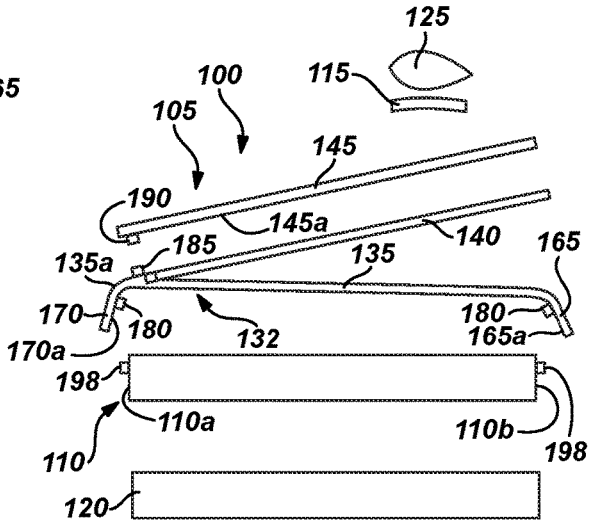
FIG. 2 is an exploded, side view of an exemplary embodiment of the present invention.
Figure 3:
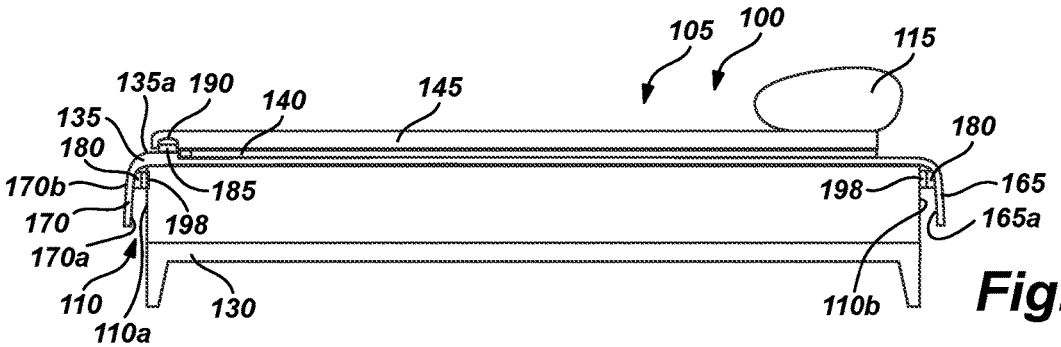
FIG. 3 is a side view of an exemplary embodiment of the present invention.

FIGS. 1-3 illustrate an exemplary embodiment of the exemplary disclosed system, apparatus, and method. System 100 may include a bedding assembly 105, a mattress assembly 110, and a bedding member 115. Bedding assembly 105 may be removably attached to mattress assembly 110. System 100 may cover a mattress 120 and a pillow 125 that may be supported on a bed 130. Mattress 120 and bed 130 may be any suitable type or size of bed such as, for example, a twin, a single, a double, a full, a queen, or a king size bed.

Bedding assembly 105 may include a first sheet member (e.g., a bottom sheet member 135), a second sheet member (e.g., a top sheet member 140), and a cover member 145. Sheet members 135 and 140 may be attached to each other or integrally formed, and cover member 145 may be removably attached to members 135 and/or 140. For example, sheet members 135 and 140 may form a sheet assembly 132. A person using system 100 may sleep between sheet members 135 and 140.

Figure 6:
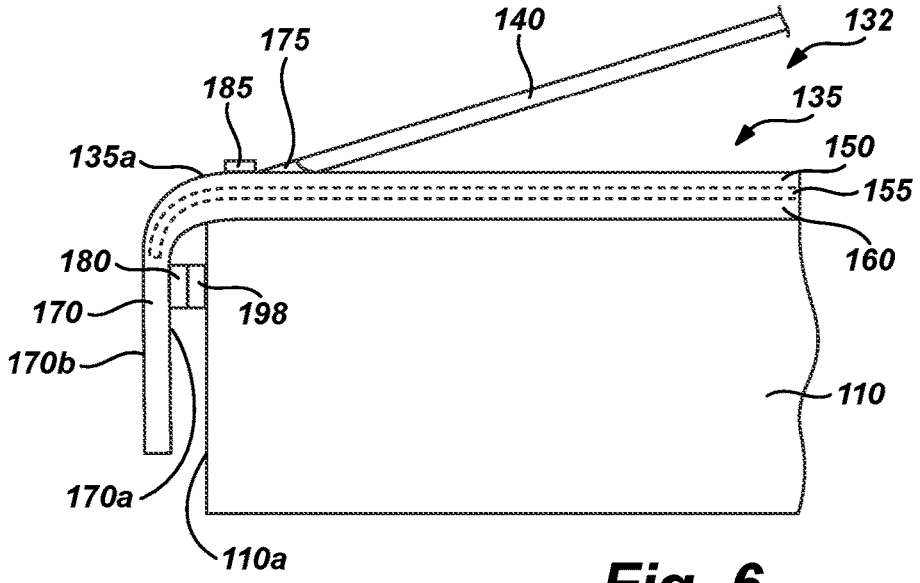
FIG. 6 is a detailed view of an exemplary embodiment of the present invention.
Figure 7:
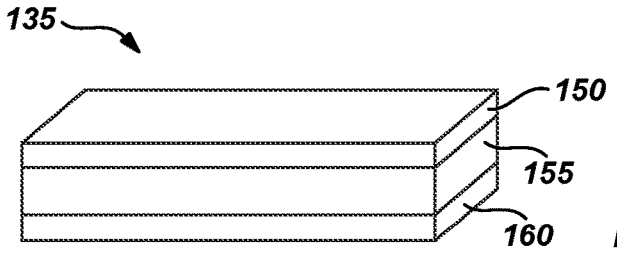
FIG. 7 is a sectional, perspective view of an exemplary embodiment of the present invention.

Bottom sheet member 135 may be any suitable member for providing bedding (e.g., a bed sheet, bed linen, bed clothes, and/or a bed covering). For example, bottom sheet member 135 may be a bed sheet. As illustrated in FIGS. 6 and 7, bottom sheet member 135 may include a plurality of layers. For example, bottom sheet member 135 may include a top bedding layer 150, a fluid barrier layer such as a barrier layer 155, and a bottom bedding layer 160.

Top bedding layer 150 and bottom bedding layer 160 may be formed from any suitable material for forming bedding such as a bed sheet. Top bedding layer 150 and bottom bedding layer 160 may be formed from cotton, polyester, linen, Tencel, flannel, Jersey knit, microfiber, bamboo, acrylic, blend, satin, silk, and/or any other suitable bedding material.

Barrier layer 155 may be formed from any suitable material for preventing a passage of fluid such as liquid (e.g., bodily fluid). Barrier layer 155 may be an impermeable layer that does not allow liquid to pass through the layer. Barrier layer 155 may be a waterproof layer (e.g., and/or a water-resistant layer). Barrier layer 155 may be formed from any suitable waterproof material such as waterproof fabric or denier material. Barrier layer 155 may be formed from vinyl, canvas, nylon, polyester, ripstop nylon, acrylic, Textilene, waxed cotton, neoprene, and/or any other suitable waterproof material that may block (e.g., substantially block) a flow or passage of liquid. Barrier layer 155 may be formed from waterproof Ottertex® material, Goretex®, Cordura® Nylon, and/or any other suitable waterproof material. Barrier layer 155 may be formed from Thermoplastic polyurethane, Polyester microfiber, Polyurethane Laminate, Terylene, Densely-woven fabrics, PVC-coated Polyester, Nylon taffeta, Laminated cotton or poplin, polyethylene vinyl acetate, and/or any other suitable material.

Barrier layer 155 may be disposed between top bedding layer 150 and bottom bedding layer 160. Layers 150, 155, and 160 may be attached (e.g., fixedly attached) via any suitable technique such as, for example, stitching, sewing, fusing, adhesion (e.g., adhesive material), and/or any other suitable attachment technique. Barrier layer 155 may prevent (e.g., substantially prevent) liquid from flowing from top bedding layer 150 to bottom bedding layer 160. For example, bottom bedding layer 160 may remain clean and dry when top bedding layer 150 becomes wet, soiled, and/or dirty. In at least some exemplary embodiments, bottom sheet member 135 may include top bedding layer 150 and barrier layer 155 (e.g., without bottom bedding layer 160).

Bottom sheet member 135 may include a first overhang portion (e.g., a head overhang portion 165) and a second overhang portion (e.g., a foot overhang portion 170). As illustrated in FIGS. 3 and/or 6, head overhang portion 165 may overhang a side of mattress 120 at a head side of bed 130 and foot overhang portion 170 may overhang a side of mattress 120 at a foot side of bed 130. In at least some exemplary embodiments, foot overhang portion 170 may be a portion of top sheet member 140.

Figure 4:
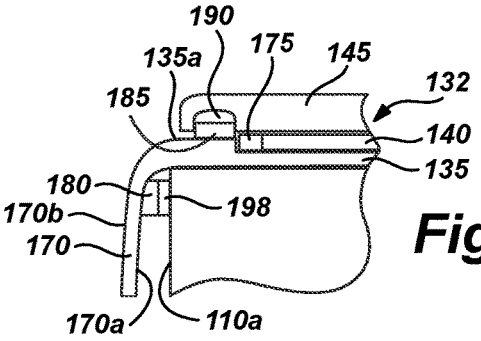
FIG. 4 is a detailed view of an exemplary embodiment of the present invention.

Top sheet member 140 may be formed from material similar to top bedding layer 150 and bottom bedding layer 150. In at least some exemplary embodiments, bottom sheet member 135 and top sheet member 140 may be integral portions of a single member. For example, top sheet member 140 may be integrally formed with top bedding layer 150 of bottom sheet member 135. Also for example and as illustrated in FIGS. 4 and 6, top sheet member 140 may be attached (e.g., fixedly attached) to bottom sheet member 135 at attachment portion 175 via any suitable attachment technique such as, for example, stitching, sewing, fusing, adhesion (e.g., adhesive material), and/or any other suitable attachment technique. Further for example, top sheet member 140 may be removably attached to bottom sheet member 135 at attachment portion 175 via the exemplary disclosed removable attachment techniques (e.g., hook and loop) described herein.

One or more removable fasteners 180 may be attached (e.g., fixedly attached) to bottom sheet member 135 via any suitable attachment technique such as, for example, stitching, sewing, fusing, adhesion (e.g., adhesive material), and/or any other suitable attachment technique. For example and as illustrated in FIGS. 1-4 and 6, a first removable fastener 180 may be fixedly attached at an interior surface 170*a* of foot overhang portion 170, and a second removable fastener 180 may be fixedly attached at an interior surface 165*a* of head overhang portion 165. Removable fasteners 180 may thereby face mattress assembly 110.

Removable fastener 180 may be any suitable component for removably attaching (e.g., providing removable attachments between) the exemplary disclosed components of system 100. For example, removable fastener 180 may be any suitable component for removably attaching bottom sheet member 135 to mattress assembly 110. Removable fastener 180 may be configured to attach to a corresponding removable fastener of mattress assembly 110 to form a removable attachment between bottom sheet member 135 and mattress assembly 110. Removable fastener 180 may include a hook and loop fastener (e.g., a hook portion or a loop portion of a hook and loop fastener), a magnet, a zipper component (e.g., a slider and/or a teeth or chain half), an removably adhesive surface or a surface configured to attach to a removably adhesive surface, a button or a recess configured to receive a button, a clip or a clip receiver configured to attach to a clip, a carabiner or a carabiner receiver configured to attach to a carabiner, or any other suitable removable attachment component. In at least some exemplary embodiments, removable fastener 180 may include a hook strip or a loop strip, or one or more hook or strip portions (e.g., a plurality of hook or strip portions, dots, or patches). For example in at least some exemplary embodiments, attachment portion 175 described above may include a first fastener component similar to removable fastener 180 that may be fixedly attached to bottom sheet member 135 and a second fastener component similar to removable fastener 180 that may be fixedly attached to top sheet member 140, the second fastener component configured to form a removable attachment with the first fastener component to removably attach bottom sheet member 135 and top sheet member 140.

One or more removable fasteners 185 may be attached (e.g., fixedly attached) to bottom sheet member 135 (e.g., and/or top sheet member 140) via any suitable attachment technique such as, for example, stitching, sewing, fusing, adhesion (e.g., adhesive material), and/or any other suitable attachment technique. Removable fastener 185 may be similar to removable fastener 180. For example and as illustrated in FIGS. 1-4 and 6, removable fastener 185 may be fixedly attached at a top surface 135*a* of bottom sheet member 135 (e.g., and/or top sheet member 140). Removable fastener 185 may also be fixedly attached at an exterior surface 170*b* of foot overhang portion 170. Removable fastener 185 may face cover member 145.

Cover member 145 may be any suitable cover for bedding. For example, cover member 145 may be a blanket or a comforter. Cover member 145 may be formed from wool, cotton, fleece, woven acrylic, knitted polyester, linen, silk, down, and/or any other suitable material for providing warmth and/or comfort to a person using system 100.

One or more removable fasteners 190 may be attached (e.g., fixedly attached) to cover member 145 via any suitable attachment technique such as, for example, stitching, sewing, fusing, adhesion (e.g., adhesive material), and/or any other suitable attachment technique. Removable fastener 190 may be similar to removable fastener 180. For example and as illustrated in FIGS. 1-4, removable fastener 190 may be fixedly attached at a bottom surface 145*a* of cover member 145. Removable fastener 190 may thereby face top sheet member 140 (e.g., and/or bottom sheet member 135). For example, removable fastener 190 may face removable fastener 185 of bottom sheet member 135 (e.g., and/or top sheet member 140). Removable fasteners 185 and 190 may be removably fastened together to form a removable attachment for example as illustrated in FIGS. 3 and 4 to removably attach cover member 145 to bottom sheet member 135 (e.g., and/or top sheet member 140).

Mattress assembly 110 may be any suitable assembly for being secured around mattress 120 to provide a removable attachment of bedding assembly 105 to mattress 120. Mattress assembly 110 may be a mattress hugger. Mattress assembly 110 may be permanently attached to mattress 120 for example as described below. Mattress assembly 110 may be formed from materials similar to top bedding layer 150, bottom bedding layer 160, and/or barrier layer 155 for example as described above. Also for example, mattress assembly 110 may be formed from materials that may not involve cleaning or laundering such as, for example, plastic, non-washable fabric, and/or any other suitable material that may not be cleaned. For example in at least some exemplary embodiments, mattress assembly 110 may not be washed or removed from mattress 120. Mattress assembly 110 may include flexible or elastic portions so that mattress assembly 110 may be fit or wrapped around multiple sides of mattress 120.

As illustrated in FIG. 1, mattress assembly 110 may be secured around mattress 120 so that an entire bottom surface and some or all side surfaces of mattress 120 may be covered by mattress assembly 110. For example, mattress assembly 110 may include an aperture 195 through which an end of mattress 120 may be inserted as mattress assembly 110 is wrapped and secured around mattress 120. Accordingly in at least some exemplary embodiments, aperture 195 may be disposed at a top surface of mattress 120 as opposed to a bottom surface of mattress 120, which may help to keep mattress assembly 110 securely attached and secured around mattress 120 when bedding assembly 105 is removably attached and detached from mattress assembly 110 over a period of use. For example, mattress assembly 110 may be secured "upside down" to mattress 120 based on aperture 195 being disposed at the top surface of mattress 120 as opposed to a bottom surface of mattress 120. For example, mattress assembly 110 may be permanently attached to mattress 120 for a period of years without being removed, with the attachment of mattress assembly 110 to mattress 120 for example as illustrated in FIG. 1 being maintained. For example, once permanently attached, mattress assembly 110 may remain permanently attached to mattress 120 for a remaining service life of mattress 120 if desired. For example, mattress assembly 110 may not involve cleaning or laundering or be removed over a service life of mattress 120 if desired. In at least some exemplary embodiments, mattress assembly 110 may not be meant to be removed from mattress 120 and may remain permanently attached to mattress 120, which may facilitate a quick stripping and bed-making using bedding assembly 105 for example as described herein.

Figure 8:
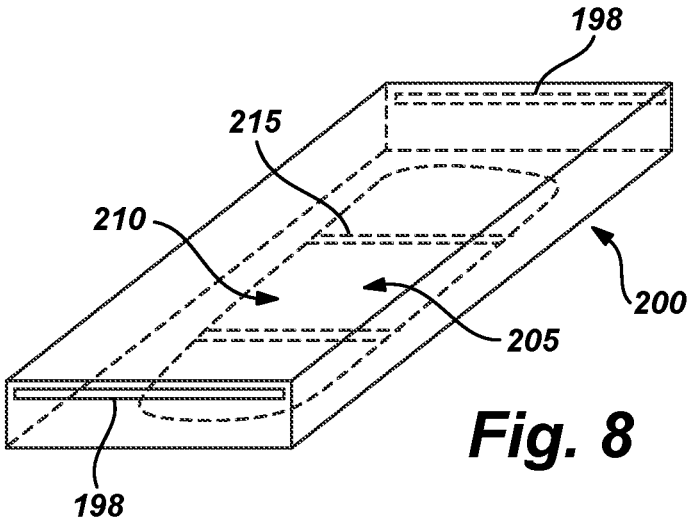
FIG. 8 is a perspective view of an exemplary embodiment of the present invention.

FIG. 8 illustrates another exemplary embodiment for permanent attachment of the exemplary disclosed mattress assembly to mattress 120. Mattress assembly 200 may be similar to mattress assembly 110. Aperture 205 of mattress assembly 200 may be disposed at a bottom surface of mattress 120. An attachment assembly 210 may be attached to end portions of mattress assembly 200 forming aperture 205, and may substantially prevent aperture 205 from increasing in size and may thereby maintain mattress assembly 200 securely wrapped and attached around mattress 120. For example, attachment assembly 210 may include a plurality of members 215 (e.g., straps) that may maintain aperture 205 at a substantially constant size. For example, members 215 may be straps formed for any suitable elastic material (e.g., natural or synthetic rubber) that may maintain a tension force on end portions of mattress assembly 200 to maintain aperture 205 at a substantially constant size. Members 215 may be attached or installed after mattress 120 is inserted into mattress assembly 200 via aperture 205.

Returning to FIGS. 1-4 and 6, one or more removable fasteners 198 may be attached (e.g., fixedly attached) to mattress assembly 110 (e.g., or mattress assembly 200) via any suitable attachment technique such as, for example, stitching, sewing, fusing, adhesion (e.g., adhesive material), and/or any other suitable attachment technique. Removable fastener 198 may be similar to removable fastener 180. For example and as illustrated in FIGS. 1-4 and 6, a first removable fastener 198 may be fixedly attached at a foot side surface 110*a* of mattress assembly 110, and a second removable fastener 198 may be fixedly attached at a head side surface 110*b* of mattress assembly 110. Removable fasteners 198 may thereby face bottom sheet member 135 (e.g., and/or top sheet member 140). For example, removable fasteners 198 may face removable fasteners 180 of bottom sheet member 135 (e.g., and/or top sheet member 140). Removable fasteners 180 and 198 may be removably fastened together to form removable attachments for example as illustrated in FIGS. 3, 4, and 6 to removably attach bottom sheet member 135 (e.g., and/or top sheet member 140) to mattress assembly 110.

Figure 9:
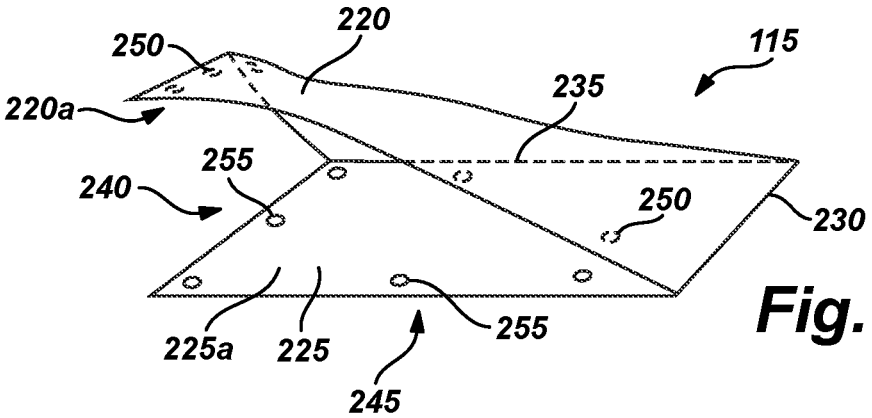
FIG. 9 is a perspective view of an exemplary embodiment of the present invention.

In at least some exemplary embodiments and as illustrated in FIG. 9, bedding member 115 may be formed from similar material to top bedding layer 150 and bottom bedding layer 160 for example as described above. Bedding member 115 may be a pillow case or any other suitable member for housing, containing, and/or covering pillow 125. An upper layer 220 and a lower layer 225 of bedding member 115 may be attached (e.g., fixedly attached) at a plurality of side portions (e.g., side portions 230 and 235) via any suitable technique such as, for example, stitching, sewing, fusing, adhesion (e.g., adhesive material), and/or any other suitable attachment technique. Upper layer 220 and lower layer 225 may be unattached at a plurality of side portions (e.g., side portions 240 and 245) so that bedding member 115 may be selectively opened at side portions 240 and 245 to receive pillow 125.

Upper layer 220 may include one or more removable fasteners 250 at each of side portions 240 and 245 that may be fixedly attached to an interior surface 220*a* of upper layer 220. Lower layer 225 may include one or more removable fasteners 255 at each of side portions 240 and 245 that may be fixedly attached to an interior surface 225*a* of lower layer 225. Removable fasteners 250 and 255 may be similar to removable fastener 180 and may be attached (e.g., fixedly attached) to respective upper layer 220 and lower layer 225 via any suitable attachment technique such as, for example, stitching, sewing, fusing, adhesion (e.g., adhesive material), and/or any other suitable attachment technique. For example as illustrated in FIG. 9, removable fasteners 250 may be aligned with and may face respective removable fasteners 255. Removable fasteners 250 and 255 may be removably fastened together to form a removable attachment to removably attach upper layer 220 and lower layer 225 at side portions 240 and 245, thereby substantially completely surrounding and securing pillow 125 within bedding member 115 when pillow 125 is disposed between interior surfaces 220*a* and 225*a*. Pillow 125 may thereby be easily inserted into bedding member 115 when side portions 240 and 245 are open, and then easily housed or secured in bedding member 115 when removable fasteners 250 and 255 are removably fastened together to close side portions 240 and 245. Removable fasteners 250 and 255 may include fastener portions, dots, or patches and/or fastener strip portions for example as described above regarding removable fastener 180. In at least some exemplary embodiments, a plurality of removable fasteners 250 and 255 that may be dots may be spaced along upper layer 220 and lower layer 225 at side portions 240 and 245. Also for example, removable fasteners 250 and 255 that may be strip fasteners may be disposed along upper layer 220 and lower layer 225 at side portions 240 and 245.

Removable fasteners 180, 185, 190, 198, 250, and 255 may be color-coded to facilitate removable attachment. Removable fasteners 180, 185, 190, 198, 250, and 255 may be of any desired color such as, for example, red, orange, yellow, green, blue, violet, or any other desired color. For example, removable fasteners 180 and 198 may be of a first color, and removable fasteners 185 and 190 may be of a second color. The exemplary disclosed color-coding may make it easier for users to recognize that corresponding removable fasteners 180 and 198 may be removably attached and that corresponding removable fasteners 185 and 190 may be removably attached for example as described herein. Also for example, each of removable fasteners 250 may be one of a plurality of colors that may correspond to colors of aligned removable fasteners 255 (e.g., aligned as illustrated in FIG. 9). In at least some exemplary embodiments such as for providing bedding for children, matching color-coded removable fasteners may turn bedmaking into a game in which exemplary disclosed removable fasteners having the same color may be removably attached together to make a bed.

Figure 10:
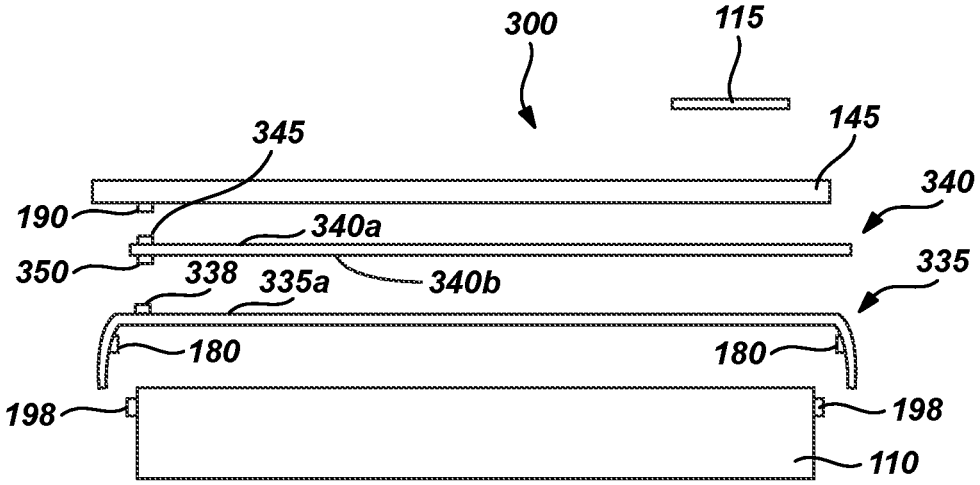
FIG. 10 is an exploded, side view of an exemplary embodiment of the present invention.

FIG. 10 illustrates another exemplary embodiment of the exemplary disclosed system, apparatus, and method. System 300 may include mattress assembly 110, bedding member 115, and cover member 145. System 300 may also include a bottom sheet member 335 that may be generally similar to bottom sheet member 135 and a top sheet member 340 that may be generally similar to top sheet member 140. Bottom sheet member 335 may be a separate sheet member from top sheet member 340. Top sheet member 340 may be removably attached between bottom sheet member 335 and cover member 145 for example as described below.

Removable fasteners 180 of bottom sheet member 335 may be removably attached to removable fasteners 198 of mattress assembly 110. Bottom sheet member 335 may also include a removable fastener 338 at a top surface 335*a* for example as illustrated in FIG. 10. Removable fastener 338 may be similar to removable fastener 180. Top sheet member 340 may include a removable fastener 345 that may be similar to removable fastener 180 and that may be disposed at a top surface 340*a* of top sheet member 340. Top sheet member 340 may also include a removable fastener 350 that may be similar to removable fastener 180 and that may be disposed at a bottom surface 340*b* of top sheet member 340. Bottom sheet member 335 may be removably attached to mattress assembly 110 based on removable fasteners 180 being removably fastened to corresponding removable fasteners 198. Top sheet member 340 may be removably attached between bottom sheet member 335 and cover member 145 based on removable fastener 338 being removably fastened to removable fastener 350, and based on removable fastener 345 being removably fastened to removable fastener 190. The exemplary disclosed removable fasteners of system 300 may be color-coded for example as described above.

Figure 11A:
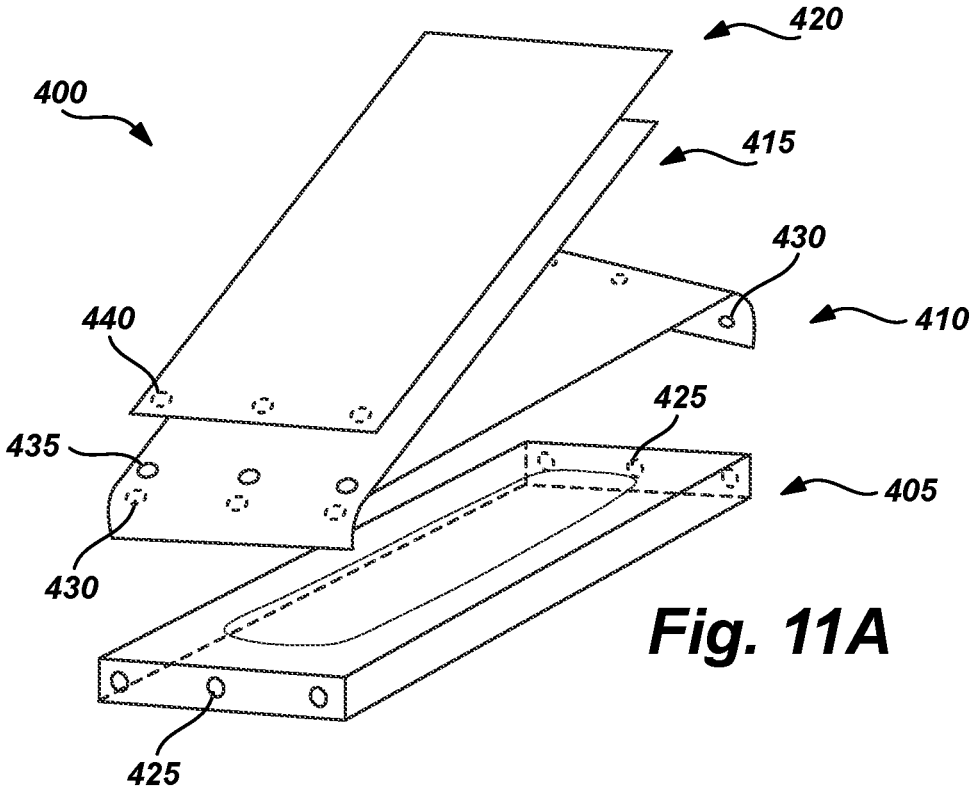
FIG. 11A is an exploded, perspective view of an exemplary embodiment of the present invention.

FIG. 11A illustrates another exemplary embodiment of the exemplary disclosed system, apparatus, and method. System 400 may include a mattress assembly 405 that may be generally similar to mattress assembly 110, a bottom sheet member 410 that may be generally similar to bottom sheet member 135 and that may be attached to a top sheet member 415 that may be generally similar to top sheet member 140, and a cover member 420 that may be generally similar to cover member 145. Mattress assembly 405 may include a plurality of removable fasteners 425 that may be similar to removable fastener 180 and that may be removably attached to a corresponding (e.g., aligned) plurality of removable fasteners 430 disposed at a bottom surface of bottom sheet member 410 that may be similar to removable fastener 180. Bottom sheet member 410 may include a plurality of removable fasteners 435 disposed at a top surface of bottom sheet member 410 (e.g., or top sheet member 415) that may be similar to removable fastener 180 and that may be removably attached to a corresponding (e.g., aligned) plurality of removable fasteners 440 disposed at a bottom surface of cover member 420 that may be similar to removable fastener 180. In at least some exemplary embodiments, removable fasteners 425, 430, 435, and 440 may be portions, dots, or patches. The exemplary disclosed removable fasteners of system 400 may be color-coded for example as described above.

Figure 11B:
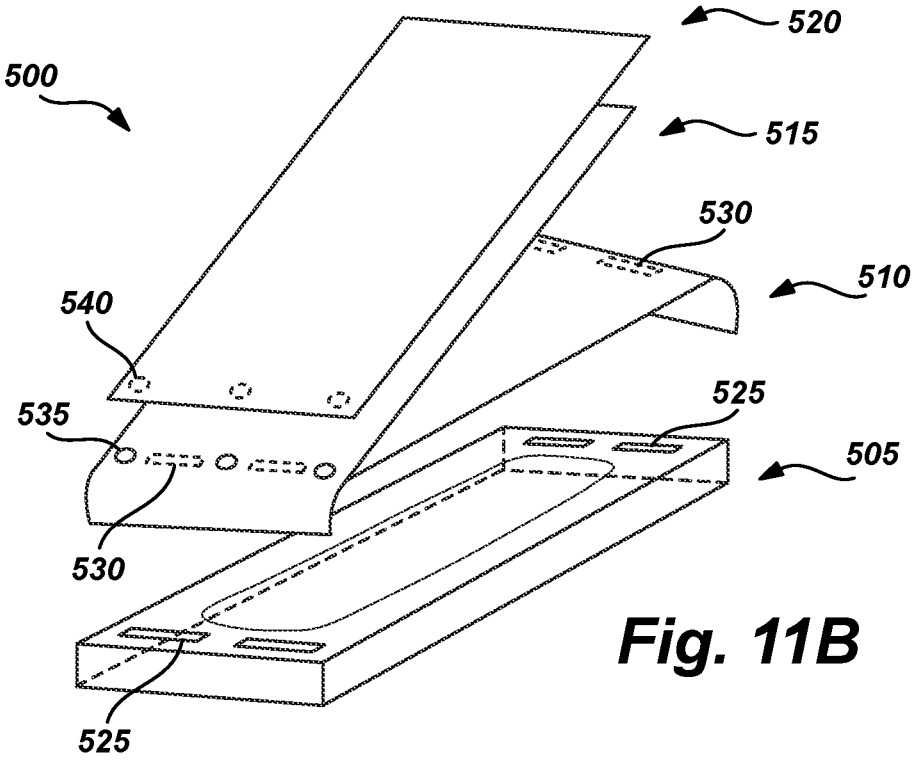
FIG. 11B is an exploded, perspective view of an exemplary embodiment of the present invention.

FIG. 11B illustrates another exemplary embodiment of the exemplary disclosed system, apparatus, and method. System 500 may include a mattress assembly 505 that may be generally similar to mattress assembly 110, a bottom sheet member 510 that may be generally similar to bottom sheet member 135 and that may be attached to a top sheet member 515 that may be generally similar to top sheet member 140, and a cover member 520 that may be generally similar to cover member 145. Mattress assembly 505 may include a plurality of removable fasteners 525 that may be similar to removable fastener 180 and that may be removably attached to a corresponding (e.g., aligned) plurality of removable fasteners 530 disposed at a bottom surface of bottom sheet member 510 that may be similar to removable fastener 180. Removable fasteners 525 may be disposed at a top surface of mattress assembly 505 for example as illustrated in FIG. 11B. Mattress assembly 505 may also include a plurality of removable fasteners 535 that may be disposed at a reverse surface (e.g., opposite surface) of bottom sheet member 510 (e.g., or top sheet member 515) than removable fasteners 530 for example as illustrated in FIG. 11B. Removable fasteners 535 may be removably attached to a corresponding (e.g., aligned) plurality of removable fasteners 540 disposed at a bottom surface of cover member 420 that may be similar to removable fastener 180. In at least some exemplary embodiments, removable fasteners 525, 530, 535, and 540 may be portions, dots, patches, and/or strips (e.g., as illustrated in FIG. 11B). The exemplary disclosed removable fasteners of system 500 may be color-coded for example as described above.

The exemplary disclosed system, apparatus, and method may be used in any suitable application for providing and using bedding. For example, the exemplary disclosed system, apparatus, and method may be used for making any suitable type or size of bed. The exemplary disclosed system, apparatus, and method may be used in any suitable application for stripping used sheets and blankets from a bed and replacing those used sheets and blankets with clean sheets and blankets.

Figure 12:
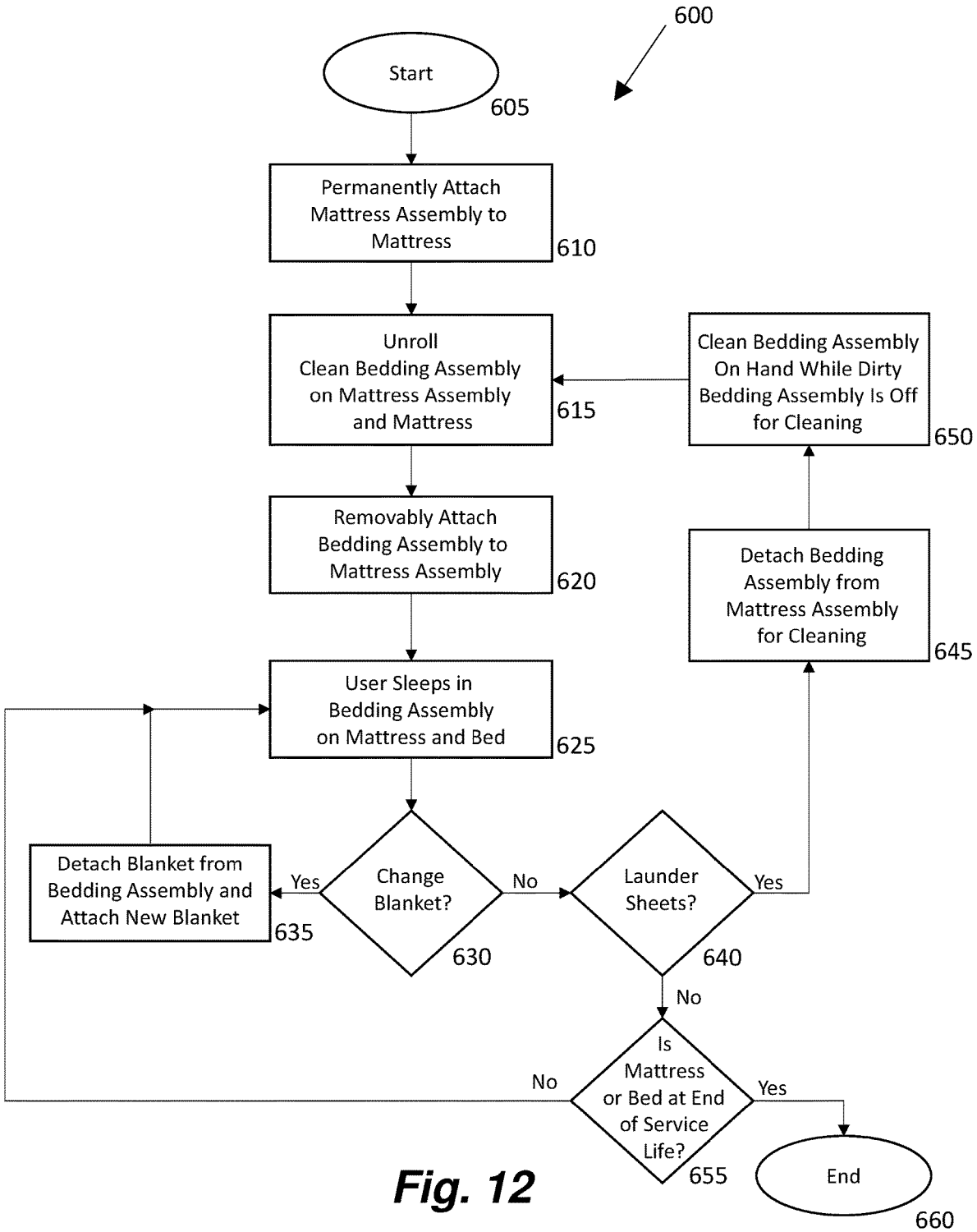
FIG. 12 illustrates an exemplary process of at least some exemplary embodiments of the present disclosure.

FIG. 12 illustrates an exemplary operation of the exemplary disclosed system 100. Systems 300, 400, and 500 may operate similarly. Process 600 begins at step 605. At step 610, mattress assembly 110 may be attached (e.g., permanently attached) to mattress 120. For example, mattress 120 may be inserted into aperture 195 of mattress assembly 110 so that mattress assembly 110 extends around a bottom and side surfaces of mattress 120. Mattress assembly 110 may be thereby securely attached to mattress 120 during repeated attachment and detachment of bedding assembly 105 to mattress assembly 110 over a service life of mattress assembly 110, mattress 120, and/or bed 130. For example, mattress assembly 110 may remain permanently attached to mattress 120 for a remaining service life of mattress 120 as steps of process 600 are iteratively performed.

Figure 5:
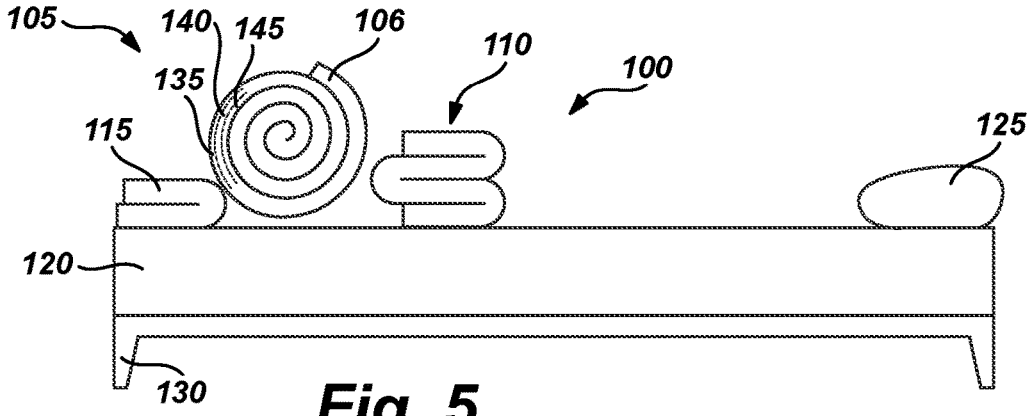
FIG. 5 is a side view of an exemplary embodiment of the present invention.

At step 615, bedding assembly 105 may be unrolled on mattress assembly 110 and mattress 120 (e.g., and bed 130). For example as illustrated in FIG. 5, clean bedding assembly 105 may be provided in a roll 106. Bottom sheet member 135, top sheet member 140, and cover member 145 may be rolled together into roll 106. Clean bedding assembly 105 may be stored as roll 106 for example with a foot side (e.g., or head side) at an outside of roll 106. For example, foot overhang portion 170 (e.g., or head overhang portion 165) may be disposed at an outside of roll 106. Cover member 145 may be removably attached to bottom sheet member 135 (e.g., and/or top sheet member 140) when bedding assembly 105 is in the form or configuration of roll 106. Roll 106 may be placed on mattress assembly 110 housing mattress 120 and unrolled (e.g., pushed along a length of mattress assembly 110 and mattress 120) so that a full length (e.g., or a partial length) of bedding assembly 105 extends along a length of mattress assembly 110 and mattress 120. For example, roll 106 having foot overhang portion 170 at an outside of roll 106 may be placed at a foot side of mattress assembly 110 and mattress 120 (e.g., and bed 130) and unrolled by pushing roll 106 to roll toward a head side (e.g., from near foot overhang portion 170 toward head overhang portion 165) of mattress assembly 110 and mattress 120 (e.g., and bed 130).

Returning to FIG. 12 at step 620, bedding assembly 105 may be removably attached to mattress assembly 110. Removable fasteners 180 of bottom sheet member 135 may be removably attached to corresponding removable fasteners 198 of mattress assembly 110. If cover member 145 is not already removably attached to bottom sheet member 135 (e.g., and/or top sheet member 140), cover member 145 may be removably attached to bottom sheet member 135 (e.g., and/or top sheet member 140) based on removable fastener 190 of cover member 145 being removably attached to removable fastener 185 of bottom sheet member 135 (e.g., and/or top sheet member 140).

Also for example at step 620, pillow 125 may be inserted through open side portions 240 and 245 of bedding member 115. Once pillow 125 has been inserted into bedding member 115 between interior surfaces 220*a* and 225*a*, side portions 240 and 245 may be removably attached together based on removably attaching corresponding removable fasteners 250 and 255. Bedding assembly 105 may now be ready for use.

At step 625, a user may sleep, lay, or rest in bedding assembly 105 that is removably attached to mattress assembly 110 that may be permanently attached to mattress 120. A user may sleep multiple nights, days, or periods using bedding assembly 105 until bedding assembly 105 has become soiled, dirty, or a certain period of time has elapsed (e.g., a week). The user may sleep, lay, or rest between bottom sheet member 135 and top sheet member 140. The user may thereby sleep, lay, or rest above barrier layer 155 of bottom sheet member 135, with barrier layer 155 of bottom sheet member 135 separating the user from mattress assembly 110. Barrier layer 155 may thereby prevent (e.g., substantially prevent) bodily fluids (e.g., including sweat, urine, blood, and/or other bodily fluids) of the user sleeping, laying, or resting in bedding assembly 105 from contacting or reaching mattress assembly 110.

At step 630, a user may determine whether or not cover member 145 is to be replaced with a different cover member 145. If cover member 145 is to be replaced with a different cover member 145, process 600 may proceed to step 635. At step 635, a user may detach cover member 145 by detaching removable fastener 190 of cover member 145 from removable fastener 185 of bottom sheet member 135 (e.g., and/or top sheet member 140). Cover member 145 may be removed from bedding assembly 105. A new cover member 145 may be provided that may for example be clean, have a different design (e.g., for example a new toy, game, or character depiction or design for children's bedding), have varied thickness to address temperature changes, and/or any other desired differences. New cover member 145 may be removably attached to bottom sheet member 135 (e.g., and/or top sheet member 140) based on removable fastener 190 of cover member 145 being removably attached to removable fastener 185 of bottom sheet member 135 (e.g., and/or top sheet member 140). Process 600 may return to step 625.

If cover member 145 is not to be replaced with a different cover member 145 at step 630, process 600 may proceed to step 640. At step 640, a user may determine whether or not bedding assembly 105 is to be cleaned, laundered, or replaced for any desired reason (e.g., a different user is to sleep on bed 130). If bedding assembly 105 is to be cleaned, laundered, or replaced, process 600 may proceed to step 645.

At step 645, bedding assembly 105 may be detached from mattress assembly 110. Removable fasteners 180 of bottom sheet member 135 (e.g., and/or top sheet member 140) may be detached from corresponding removable fasteners 198 of mattress assembly 110. Cover member 145 that may be removably attached to bottom sheet member 135 (e.g., and/or top sheet member 140) may be removed with bottom sheet member 135 and top sheet member 140. If desired, bedding assembly 105 may be rolled into roll 106 for easy handling and transport. Also for example, bedding assembly 105 may be put directly into a dirty clothing storage container and washed with any other suitable items in a load of laundry.

Also for example at step 645, bedding member 115 may be removed from pillow 125. Side portions 240 and 245 may be opened based on detaching corresponding removable fasteners 250 and 255. Pillow 125 may be removed through open side portions 240 and 245 of bedding member 115. Bedding member 125 may then be cleaned or handled similarly to as described above regarding bedding assembly 105. For example if desired, bedding member 125 may be rolled up with bedding assembly 105 in roll 106 or handled separately as desired.

At step 650, a clean bedding assembly 105 may be on-hand and/or obtained while used bedding assembly 105 is handled and/or cleaned at step 645. For example at step 650, a clean bedding assembly 105 may be obtained from any suitable clean bedding or clothing storage such as a cabinet or linen closet. Clean bedding assembly 105 may be stored and/or obtained configured as roll 106. For example, a household, hospital, care facility, or any other suitable facility may maintain a plurality of clean bedding assemblies 105 rolled as rolls 106 on hand to facilitate quick replacement of bedding. Process 600 may return to step 615 using the clean bedding assembly 105 provided at step 650.

If bedding assembly 105 is not to be cleaned, laundered, or replaced at step 640, process 600 may proceed to step 655. At step 655, a user may determine whether or not mattress 120 (e.g., and/or mattress assembly 110 attached to mattress 120) and/or bed 130 has reached an end of service life and/or is to be replaced for any desired reason. If an end of service life has not been reached and system 100 may continue to be used, process 600 may return to step 625. If an end of service life has been reached and mattress 120 (e.g., and/or mattress assembly 110 attached to mattress 120) and/or bed 130 is no longer to be used, process 600 may proceed to step 660 and process 600 ends. If mattress assembly 110 is not at the end of its service life, mattress assembly 110 may be utilized with a different mattress 120 and/or bed 130, and process 600 may be repeated with mattress assembly 110 using another mattress 120 and/or bed 130.

Steps 615 through 655 of process 600 may be performed for any desired number of iterations after mattress assembly 110 is attached (e.g., permanently attached) to mattress 120. For example, steps 615 through 655 may be iteratively performed over several or many years, with dirty or soiled bedding assemblies 105 being replaced with clean bedding assemblies 105 many times, hundreds of times, or more.

A dirty or soiled bedding assembly 105 may be quickly stripped and replaced with a clean bedding assembly 105 using system 100 and process 600. For example, steps 645, 650, and 615 of process 600 may be performed in as quickly as 10 seconds or less. Dirty or soiled bedding may thereby be rapidly stripped and replaced with clean bedding using system 100 and process 600.

In at least some exemplary embodiments, the exemplary disclosed system, apparatus, and method may provide easy-on, easy-off bedding in which a bed may be stripped (e.g., dirty layers torn off) and made (e.g., clean layers stuck on) in a relatively short time (e.g., less than a minute such as in less than 10 seconds). Barrier layer 155 (e.g., a waterproof layer) may substantially eliminate having a separate mattress protector. Cover member 145 may be easily interchangeable. Because mattress assembly 110 may be permanently attached to mattress 120, lifting mattress 120 and/or tucking bedding under mattress 120 may not be involved with the exemplary disclosed system, apparatus, and method.

In at least some exemplary embodiments, the exemplary disclosed method may be a method for making a bed having a mattress. The exemplary disclosed method may include permanently attaching a mattress assembly (e.g., mattress assembly 110) to the mattress, removably attaching a sheet assembly (e.g., sheet assembly 132) to the mattress assembly, the sheet assembly including a first sheet member, which includes a fluid barrier layer, and a second sheet member, and blocking fluid using the fluid barrier layer from moving from the sheet assembly to the mattress assembly when the sheet assembly is removably attached to the mattress assembly. Permanently attaching the mattress assembly to the mattress may include leaving the mattress assembly permanently attached to the mattress for a remainder of a service life of the mattress. The exemplary disclosed method may also include rolling the sheet assembly into a roll before removably attaching the sheet assembly to the mattress assembly, and unrolling the sheet assembly along the mattress assembly after rolling the sheet assembly into the roll and before removably attaching the sheet assembly to the mattress assembly. The exemplary disclosed method may further include detaching the sheet assembly from the mattress assembly after blocking fluid using the fluid barrier layer, and rolling the sheet assembly into a roll after detaching the sheet assembly, and removing the roll from the mattress assembly and the bed. Permanently attaching the mattress assembly to the mattress may include inserting an end of the mattress through an aperture of the mattress assembly, and disposing the aperture of the mattress assembly face up toward the sheet assembly when the sheet assembly is removably attached to the mattress assembly. Permanently attaching the mattress assembly to the mattress may include neither lifting the mattress nor moving the mattress when removably attaching the sheet assembly to the mattress assembly. Removably attaching the sheet assembly to the mattress assembly may include removably attaching a first removable fastener fixedly attached to a first end portion of the sheet assembly to a second removable fastener fixedly attached to a head end of the mattress assembly, and removably attaching a third removable fastener fixedly attached to a second end portion of the sheet assembly to a fourth removable fastener fixedly attached to a foot end of the mattress assembly. The exemplary disclosed method may also include detaching two removably attachable side portions of a bedding member that also includes two fixedly attached side portions, inserting a pillow through the detached removably attachable side portions and into the bedding member, removably attaching the two removably attachable side portions when the pillow is disposed within the bedding member, and disposing the pillow secured in the bedding member on the sheet assembly. The exemplary disclosed method may further include removably attaching a cover member to the sheet assembly, wherein the sheet assembly may be disposed between the cover member and the mattress assembly when the cover member is removably attached to the sheet assembly, and the sheet assembly is removably attached to the mattress assembly. The exemplary disclosed method may also include removably attaching a cover member to the sheet assembly, rolling the sheet assembly including the removably attached cover member into a roll before removably attaching the sheet assembly to the mattress assembly, and unrolling the sheet assembly including the removably attached cover member along the mattress assembly after rolling the sheet assembly into the roll and before removably attaching the sheet assembly to the mattress assembly. The exemplary disclosed method may further include removably attaching a cover member to the sheet assembly, detaching the sheet assembly including the removably attached cover member from the mattress assembly after blocking fluid using the fluid barrier layer, and rolling the sheet assembly including the removably attached cover member into a roll after detaching the sheet assembly from the mattress assembly, and removing the roll from the mattress assembly and the bed.

In at least some exemplary embodiments, the exemplary disclosed system may include an assembly for making a bed having a mattress and a pillow. The exemplary disclosed assembly may include a non-washable mattress assembly (e.g., mattress assembly 110) configured to be permanently attached to the mattress for a remainder of a service life of the mattress, a sheet assembly (e.g., sheet assembly 132) configured to be removably attached to the mattress assembly, the sheet assembly including a first sheet member, which includes a fluid barrier layer, and a second sheet member, a cover member configured to be removably attached to the sheet assembly, and a bedding member that may include two fixedly attached side portions and two removably attachable side portions configured to receive the pillow through the two removably attachable side portions when the two removably attachable side portions are detached. The first sheet member may include a first bedding layer and a second bedding layer, the fluid barrier layer being a waterproof layer disposed between the first bedding layer and the second bedding layer. The exemplary disclosed assembly may also include a first removable fastener of a first color that is fixedly attached to a first end portion of the sheet assembly, a second removable fastener of the first color that is fixedly attached to a head end of the mattress assembly and that is configured to be removably fastened to the first removable fastener, a third removable fastener of a second color that is fixedly attached to a second end portion of the sheet assembly, and a fourth removable fastener of the second color that is fixedly attached to a foot end of the mattress assembly and that is configured to be removably fastened to the third removable fastener. The exemplary disclosed assembly may further include a fifth removable fastener of a third color that is fixedly attached to the second end portion of the sheet assembly, and a sixth removable fastener of the third color that is fixedly attached to a foot end of the cover member and that is configured to be removably fastened to the fifth removable fastener. The first, second, third, and fourth removable fasteners may each be one of a hook or a loop of a hook and loop fastener. The cover member may be a blanket or a comforter. The removably attachable side portions may be removably attachable based on a first plurality of removable fasteners being disposed at a first interior surface of a first layer of the bedding member and a second plurality of removable fasteners being disposed at a second interior surface of a second layer of the bedding member, the first interior surface and the second interior surface facing the pillow when the pillow is disposed in the bedding member. The first plurality of removable fasteners may be of a first plurality of colors and the second plurality of removable fasteners is also of the first plurality of colors. Same-colored fasteners from each of the first and second plurality of removable fasteners may be aligned with each other and configured to be removably fastened to each other.

In at least some exemplary embodiments, the exemplary disclosed method may be a method for making a bed having a mattress. The exemplary disclosed method may include permanently attaching a mattress assembly (e.g., mattress assembly 110) to the mattress, rolling a sheet assembly (e.g., sheet assembly 132) into a roll, the sheet assembly including a first sheet member, which includes a fluid barrier layer, and a second sheet member, unrolling the sheet assembly along the mattress assembly, removably attaching the sheet assembly to the mattress assembly, blocking fluid using the fluid barrier layer from moving from the sheet assembly to the mattress assembly when the sheet assembly is removably attached to the mattress assembly, detaching the sheet assembly from the mattress assembly after blocking fluid using the fluid barrier layer, and rolling the sheet assembly into the roll after detaching the sheet assembly. The exemplary disclosed method may also include removably attaching a cover member to the sheet assembly before rolling the sheet assembly into the roll. Unrolling the sheet assembly along the mattress assembly may include unrolling the cover member removably attached to the sheet assembly. Rolling the sheet assembly into the roll after detaching the sheet assembly may include rolling the cover member removably attached to the sheet assembly into the roll.

In at least some exemplary embodiments, the exemplary disclosed system, apparatus, and method may provide an efficient and effective system for quickly stripping used sheets from a bed and replacing those used sheets with clean sheets. The exemplary disclosed system, apparatus, and method may also provide for stripping and replacing sheets for a bed without lifting a mattress. The exemplary disclosed system, apparatus, and method may provide for stripping and replacing sheets for a bed without folding and unfolding bed sheets and blankets. The exemplary disclosed system, apparatus, and method may also avoid including a separate mattress protector.

It will be apparent to those skilled in the art that various modifications and variations can be made to the exemplary disclosed apparatus, system, and method. Other embodiments will be apparent to those skilled in the art from consideration of the specification and practice of the exemplary disclosed apparatus, system, and method. It is intended that the specification and examples be considered as exemplary, with a true scope being indicated by the following claims.

What is claimed is:

1. A method for making a bed having a mattress, comprising:

permanently attaching a mattress assembly to the mattress;

removably attaching a sheet assembly to the mattress assembly at one or more removable attachment portions, the sheet assembly including a first sheet member, which includes a fluid barrier layer, and a second sheet member;

blocking fluid using the fluid barrier layer from moving from the sheet assembly to the mattress assembly when the sheet assembly is removably attached to the mattress assembly;

wherein the second sheet member is fixedly attached to the first sheet member at a fixed attachment portion disposed at one end portion of the sheet assembly;

disposing the fixed attachment portion at an upper surface of the mattress assembly configured to support a user sleeping on the bed; and disposing the one or more removable attachment portions at one or more side surfaces of the mattress assembly that are adjacent to and perpendicular to the upper surface of the mattress assembly.

2. The method of claim 1, further comprising:

permanently attaching the mattress assembly to the mattress by inserting the mattress into the mattress assembly through an aperture of the mattress assembly;

permanently attaching the mattress assembly to the mattress by leaving the mattress assembly permanently attached to the mattress for a remainder of a service life of the mattress;

positioning the aperture at the upper surface of the mattress assembly at an upper surface of the mattress, instead of at a bottom surface of the mattress assembly and the mattress that is opposite to the upper surface of the mattress assembly and the mattress; and permanently attaching the mattress assembly to the mattress by covering edge portions of the upper surface of the mattress with the mattress assembly so that the aperture is disposed at a center portion of the upper surface of the mattress assembly and the mattress.

3. The method of claim 1, further comprising:

rolling the sheet assembly into a roll before removably attaching the sheet assembly to the mattress assembly; and unrolling the sheet assembly along the mattress assembly after rolling the sheet assembly into the roll and before removably attaching the sheet assembly to the mattress assembly.

4. The method of claim 1, further comprising:

detaching the sheet assembly, which includes the second sheet member fixedly attached to the first sheet member, from the mattress assembly after blocking fluid using the fluid barrier layer of the first sheet member; and rolling the sheet assembly into a roll after detaching the sheet assembly, and removing the roll from the mattress assembly and the bed.

5. The method of claim 1, wherein:

the one or more removable attachment portions includes a first removable fastener, a second removable fastener, a third removable fastener, and a fourth removable fastener;

the one or more side surfaces of the mattress assembly includes a head end side surface disposed at a head end of the mattress assembly, a foot end side surface disposed at a foot end of the mattress assembly, a first bed length side surface disposed between the head end and foot end side surfaces, and a second bed length side surface disposed between the head end and foot end side surfaces opposite to the first bed length side surface;

removably attaching the sheet assembly to the mattress assembly includes:

removably attaching the first removable fastener fixedly attached to a first end portion of the sheet assembly to the second removable fastener fixedly attached to the head end side surface of the mattress assembly; and removably attaching the third removable fastener fixedly attached to a second end portion of the sheet assembly to the fourth removable fastener fixedly attached to the foot end side surface of the mattress assembly; and wherein the first and second bed length side surfaces of the mattress assembly are flat surfaces without fasteners.

6. The method of claim 1, wherein permanently attaching the mattress assembly to the mattress includes neither lifting the mattress nor moving the mattress when removably attaching the sheet assembly to the mattress assembly.

7. The method of claim 1, wherein:

the one or more removable attachment portions includes a first removable fastener, a second removable fastener, a third removable fastener, and a fourth removable fastener;

the one or more side surfaces of the mattress assembly includes a first side surface disposed at a head end of the mattress assembly and a second side surface disposed at a foot end of the mattress assembly;

removably attaching the sheet assembly to the mattress assembly includes:

removably attaching the first removable fastener fixedly attached to a first end portion of the sheet assembly to the second removable fastener fixedly attached to the first side surface disposed at the head end of the mattress assembly; and removably attaching the third removable fastener fixedly attached to a second end portion of the sheet assembly to the fourth removable fastener fixedly attached to the second side surface disposed at the foot end of the mattress assembly;

wherein the second sheet member is fixedly attached to the first sheet member at the foot end of the mattress assembly by the fixed attachment portion that is disposed at the upper surface of the mattress assembly when the sheet assembly is removably attached to the mattress assembly.

8. The method of claim 1, further comprising:

removably attaching a cover member to the sheet assembly;

detaching the sheet assembly including the removably attached cover member from the mattress assembly after blocking fluid using the fluid barrier layer; and rolling the sheet assembly including the removably attached cover member into a roll after detaching the sheet assembly from the mattress assembly, and removing the roll from the mattress assembly and the bed.

9. The method of claim 7, further comprising removably attaching a cover member to the sheet assembly by removably attaching a fifth removable fastener fixedly attached to the cover member to a sixth removable fastener fixedly attached to the sheet assembly at the upper surface of the mattress assembly adjacent to the fixed attachment portion disposed at the upper surface of the mattress assembly.

10. The method of claim 1, further comprising:

removably attaching a cover member to the sheet assembly;

rolling the sheet assembly including the removably attached cover member into a roll before removably attaching the sheet assembly to the mattress assembly; and unrolling the sheet assembly including the removably attached cover member along the mattress assembly after rolling the sheet assembly into the roll and before removably attaching the sheet assembly to the mattress assembly.

11. An assembly for making a bed having a mattress, comprising:

a non-washable mattress assembly configured to be permanently attached to the mattress for a remainder of a service life of the mattress;

a sheet assembly configured to be removably attached to the mattress assembly, the sheet assembly including a first sheet member, which includes a fluid barrier layer, and a second sheet member;

a cover member configured to be removably attached to the sheet assembly; and wherein the second sheet member is fixedly attached to the first sheet member at a fixed attachment portion disposed at one end portion of the sheet assembly, the fixed attachment portion disposed at an upper surface of the mattress assembly configured to support a user sleeping on the bed;

wherein the mattress assembly includes a plurality of side surfaces that are adjacent to and perpendicular to the upper surface of the mattress assembly;

wherein the plurality of side surfaces of the mattress assembly includes a first side surface disposed at a head end of the mattress assembly and a second side surface disposed at a foot end of the mattress assembly;

wherein a first removable fastener that is fixedly attached to a first end portion of the sheet assembly is configured to be removably attached to a second removable fastener fixedly attached to the first side surface disposed at the head end of the mattress assembly;

wherein a third removable fastener that is fixedly attached to a second end portion of the sheet assembly is configured to be removably attached to a fourth removable fastener fixedly attached to the second side surface disposed at the foot end of the mattress assembly;

wherein the second sheet member is fixedly attached to the first sheet member at the foot end of the mattress assembly by the fixed attachment portion that is disposed at the upper surface of the mattress assembly when the sheet assembly is removably attached to the mattress assembly;

wherein the mattress assembly includes an aperture disposed at an upper surface of the mattress and configured to receive the mattress when the mattress assembly is permanently attached to the mattress; and wherein the mattress assembly is configured to cover edge portions of the upper surface of the mattress so that the aperture is disposed at a center portion of the upper surface of the mattress assembly and the mattress.

12. The assembly of claim 11, wherein:

the plurality of side surfaces of the mattress assembly further include a first bed length side surface disposed between the first and second side surfaces, and a second bed length side surface disposed between the first and second side surfaces opposite to the first bed length side surface; and the first and second bed length side surfaces of the mattress assembly are configured to be disposed along a longest dimension of the mattress and are flat surfaces without fasteners.

13. The assembly of claim 11, wherein the first sheet member includes a first bedding layer and a second bedding layer, the fluid barrier layer being a waterproof layer disposed between the first bedding layer and the second bedding layer.

14. The assembly of claim 11, wherein:

an aperture portion of the mattress assembly forming the aperture is a flexible or elastic portion; and one or more straps attached to the aperture portion are disposed across the aperture disposed at the center portion of the upper surface of the mattress assembly and the mattress.

15. The assembly of claim 11, further comprising a bedding member that includes two fixedly attached side portions and two removably attachable side portions configured to receive a pillow through the two removably attachable side portions when the two removably attachable side portions are detached; wherein:

the removably attachable side portions are removably attachable based on a first plurality of removable fasteners being disposed at a first interior surface of a first layer of the bedding member and a second plurality of removable fasteners being disposed at a second interior surface of a second layer of the bedding member, the first interior surface and the second interior surface facing the pillow when the pillow is disposed in the bedding member;

the first plurality of removable fasteners is of a first plurality of colors and the second plurality of removable fasteners is also of the first plurality of colors; and same-colored fasteners from each of the first and second plurality of removable fasteners are aligned with each other and configured to be removably fastened to each other.

16. The assembly of claim 11, wherein the first, second, third, and fourth removable fasteners are each one of a hook or a loop of a hook and loop fastener.

17. The assembly of claim 11, wherein the cover member is a blanket or a comforter.

18. A method for making a bed having a mattress, comprising:

permanently attaching a mattress assembly to the mattress;

removably attaching a sheet assembly to the mattress assembly at a first removable attachment portion and a second removable attachment portion, the sheet assembly including a first sheet member, which includes a fluid barrier layer, and a second sheet member;

blocking fluid using the fluid barrier layer from moving from the sheet assembly to the mattress assembly when the sheet assembly is removably attached to the mattress assembly;

wherein the second sheet member is fixedly attached to the first sheet member at a fixed attachment portion disposed at one end portion of the sheet assembly;

disposing the fixed attachment portion at an upper surface of the mattress assembly configured to support a user sleeping on the bed;

disposing the first removable attachment portion at the upper surface of the mattress assembly at a head end of the mattress assembly; and disposing the second removable attachment portion at the upper surface of the mattress assembly at a foot end of the mattress assembly.

19. The method of claim 18, wherein:

the first removable attachment portion includes a first removable fastener and a second removable fastener;

the second removable attachment portion includes a third removable fastener and a fourth removable fastener; and removably attaching the sheet assembly to the mattress assembly includes:

removably attaching the first removable fastener fixedly attached to a first end portion of the sheet assembly to the second removable fastener fixedly attached to the upper surface of the mattress assembly at the head end of the mattress assembly; and removably attaching the third removable fastener fixedly attached to a second end portion of the sheet assembly to the fourth removable fastener fixedly attached to the upper surface of the mattress assembly at the foot end of the mattress assembly;

wherein the second sheet member is fixedly attached to the first sheet member at the foot end of the mattress assembly by the fixed attachment portion that is disposed at the upper surface of the mattress assembly when the sheet assembly is removably attached to the mattress assembly.

20. The method of claim 18, further comprising:

permanently attaching the mattress assembly to the mattress by inserting the mattress into the mattress assembly through an aperture of the mattress assembly;

positioning the aperture at the upper surface of the mattress assembly at an upper surface of the mattress, instead of at a bottom surface of the mattress assembly and the mattress that is opposite to the upper surface of the mattress assembly and the mattress; and permanently attaching the mattress assembly to the mattress by covering edge portions of the upper surface of the mattress with the mattress assembly so that the aperture is disposed at a center portion of the upper surface of the mattress assembly and the mattress;

wherein an aperture portion of the mattress assembly forming the aperture is a flexible or elastic portion.

* * * * *